US009864297B2

(12) United States Patent
Ohhira et al.

(10) Patent No.: US 9,864,297 B2
(45) Date of Patent: Jan. 9, 2018

(54) DEVELOPING DEVICE AND IMAGE FORMING APPARATUS AND PROCESS CARTRIDGE INCORPORATING SAME

(71) Applicants: Tatsuya Ohhira, Kanagawa (JP); Atsushi Kurokawa, Kanagawa (JP); Masayuki Yamane, Kanagawa (JP); Keiichi Yoshida, Kanagawa (JP); Toshiki Hayashi, Kanagawa (JP); Sayuri Katoh, Sagamihara-shi (JP)

(72) Inventors: Tatsuya Ohhira, Kanagawa (JP); Atsushi Kurokawa, Kanagawa (JP); Masayuki Yamane, Kanagawa (JP); Keiichi Yoshida, Kanagawa (JP); Toshiki Hayashi, Kanagawa (JP); Shunji Katoh

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/282,172

(22) Filed: Sep. 30, 2016

(65) Prior Publication Data

US 2017/0090342 A1 Mar. 30, 2017

(30) Foreign Application Priority Data

Sep. 30, 2015 (JP) ..... 2015-194220

(51) Int. Cl.
*G03G 15/08* (2006.01)
*G03G 15/09* (2006.01)

(52) U.S. Cl.
CPC ..... *G03G 15/0812* (2013.01); *G03G 15/09* (2013.01); *G03G 15/0921* (2013.01); (Continued)

(58) Field of Classification Search
CPC ..... G03G 15/0812; G03G 15/09; G03G 15/0907; G03G 15/0921; G03G 15/0928; G03G 2215/0609
See application file for complete search history.

(56) References Cited

U.S. PATENT DOCUMENTS 6,337,957 B1 1/2002 Tamaki et al.
6,522,855 B1 2/2003 Katoh et al.
(Continued)

FOREIGN PATENT DOCUMENTS

JP 11-265117 9/1999
JP 2010-015120 1/2010
(Continued)

*Primary Examiner* — Carla Therrien
(74) *Attorney, Agent, or Firm* — Oblon, McClelland, Maier & Neustadt, L.L.P.

(57) ABSTRACT

A developing device includes a developer bearer, a magnetic field generator, a casing having an opening, a developer conveyor to rotate inside a developer containing compartment below the developer bearer, and a developer regulator. A side wall of the casing defines a bottom end of the opening, and the developer regulator is disposed on the side wall. The side wall includes an upper end face facing the developer bearer below an axis of the developer bearer and a curved inner face along an orbit of rotation of the developer conveyor, extending from below the developer conveyor toward the upper end face. On a virtual plane perpendicular to the axis of the developer bearer, an intersection between a tangent line to an upper end of the curved inner face and the surface of the developer bearer is in a range from a tangential magnetic-flux peak and a closest approach point.

12 Claims, 9 Drawing Sheets

(52) U.S. Cl.
CPC ..... *G03G 2215/0132* (2013.01); *G03G 2215/0838* (2013.01)

(56) References Cited

U.S. PATENT DOCUMENTS

| | | | | |
|---|---|---|---|---|
| 2003/0170049 | A1 | 9/2003 | Itoh et al. | |
| 2006/0204283 | A1* | 9/2006 | Yasuda | G03G 15/0877 399/254 |
| 2007/0104516 | A1 | 5/2007 | Katoh et al. | |
| 2009/0245882 | A1 | 10/2009 | Ozeki et al. | |
| 2009/0245889 | A1* | 10/2009 | Koetsuka | G03G 15/0921 399/277 |
| 2010/0098463 | A1* | 4/2010 | Matsumoto | G03G 15/0921 399/254 |
| 2011/0229216 | A1* | 9/2011 | Iwamura | G03G 15/0812 399/274 |
| 2012/0099902 | A1 | 4/2012 | Yoshida et al. | |
| 2012/0177414 | A1 | 7/2012 | Ikeguchi et al. | |
| 2012/0219318 | A1 | 8/2012 | Yoshida et al. | |
| 2013/0039678 | A1 | 2/2013 | Yoshida et al. | |
| 2014/0241757 | A1 | 8/2014 | Kikuchi et al. | |
| 2014/0270859 | A1 | 9/2014 | Hosokawa et al. | |
| 2014/0348551 | A1 | 11/2014 | Yamabe et al. | |
| 2016/0004184 | A1 | 1/2016 | Kikuchi et al. | |
| 2016/0018758 | A1 | 1/2016 | Hosokawa et al. | |
| 2016/0161885 | A1 | 6/2016 | Hosokawa et al. | |
| 2016/0238966 | A1* | 8/2016 | Oshikawa | G03G 15/0812 |

FOREIGN PATENT DOCUMENTS

| | | |
|---|---|---|
| JP | 2014-115325 | 6/2014 |
| JP | 2015-011042 | 1/2015 |

* cited by examiner

DEVELOPING DEVICE AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119(a) to Japanese Patent Application No. 2015-194220, filed on Sep. 30, 2015, in the Japan Patent Office, the entire disclosure of which is hereby incorporated by reference herein.

BACKGROUND

Technical Field

Embodiments of the present invention generally relate to a developing device, a process cartridge, and an image forming apparatus, such as a copier, a printer, a facsimile machine, or a multifunction peripheral (MFP) having at least two of copying, printing, facsimile transmission, plotting, and scanning capabilities.

Description of the Related Art

There are developing devices that use two-component developer including magnetic carrier (carrier particles) and toner (toner particles). For example, such developing devices include a developer containing compartment (defined by a casing of the developing device) to contain the developer, a developer bearer to carry, with a magnetic force, the developer to a developing range facing a latent image bearer, a developer regulator to adjust the amount of developer borne on the surface of the developer bearer, and a conveying screw to sire the developer and transport the developer inside the developer containing compartment.

SUMMARY

In an embodiment, a developing device includes a developer bearer to bear developer; a magnetic field generator disposed inside the developer bearer and having a developer scooping pole to attract the developer and a regulation pole to cause the developer to stand on end on the developer bearer, a casing having an opening and defining a developer containing compartment disposed below the developer bearer, a developer conveyor disposed inside the developer containing compartment and configured to rotate, and a developer regulator to adjust a layer thickness of the developer on the developer bearer. The casing includes a side wall defining a bottom end of the opening, and the developer regulator is disposed on the side wall. The side wall includes an upper end face disposed facing a surface of the developer bearer at a position below an axis of the developer bearer, and a curved inner face curved along an orbit of rotation of an outer circumference of the developer conveyor. The curved inner face extends from below the developer conveyor toward the upper end face.

In such a developing device, on a virtual plane perpendicular to the axis of the developer bearer, an intersection between a tangent line tangential to an upper end of the curved inner face and the surface of the developer bearer is positioned in a range extending from a tangential magnetic-flux peak and a closest approach point. The tangential magnetic-flux peak is positioned on the surface of the developer bearer in a range extending from the developer scooping pole to the regulation pole, and the closest approach point is disposed on the surface of the developer bearer closest to an upstream end of the upper end face in a direction of rotation of the developer bearer.

In another embodiment, a process cartridge includes a latent image bearer to bear a latent image, and the above-described developing device to develop the latent image with the developer.

In yet another embodiment, an image forming apparatus includes a latent image bearer to bear a latent image, and the above-described developing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
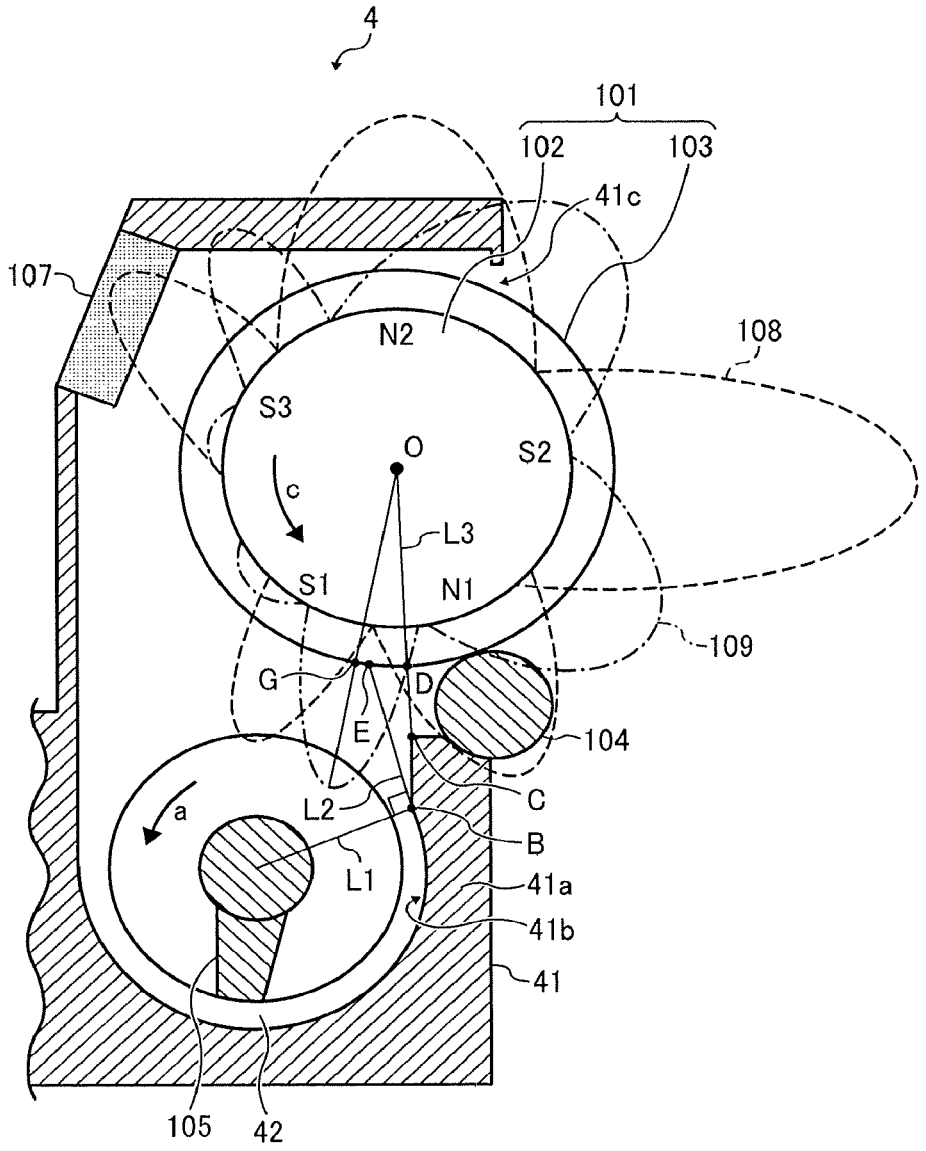
FIG. 1 is an enlarged cross-sectional view illustrating a developing roller and a supply compartment of a developing device according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a developing device according to an embodiment and an image forming apparatus incorporating the developing device is described.

Figure 2:
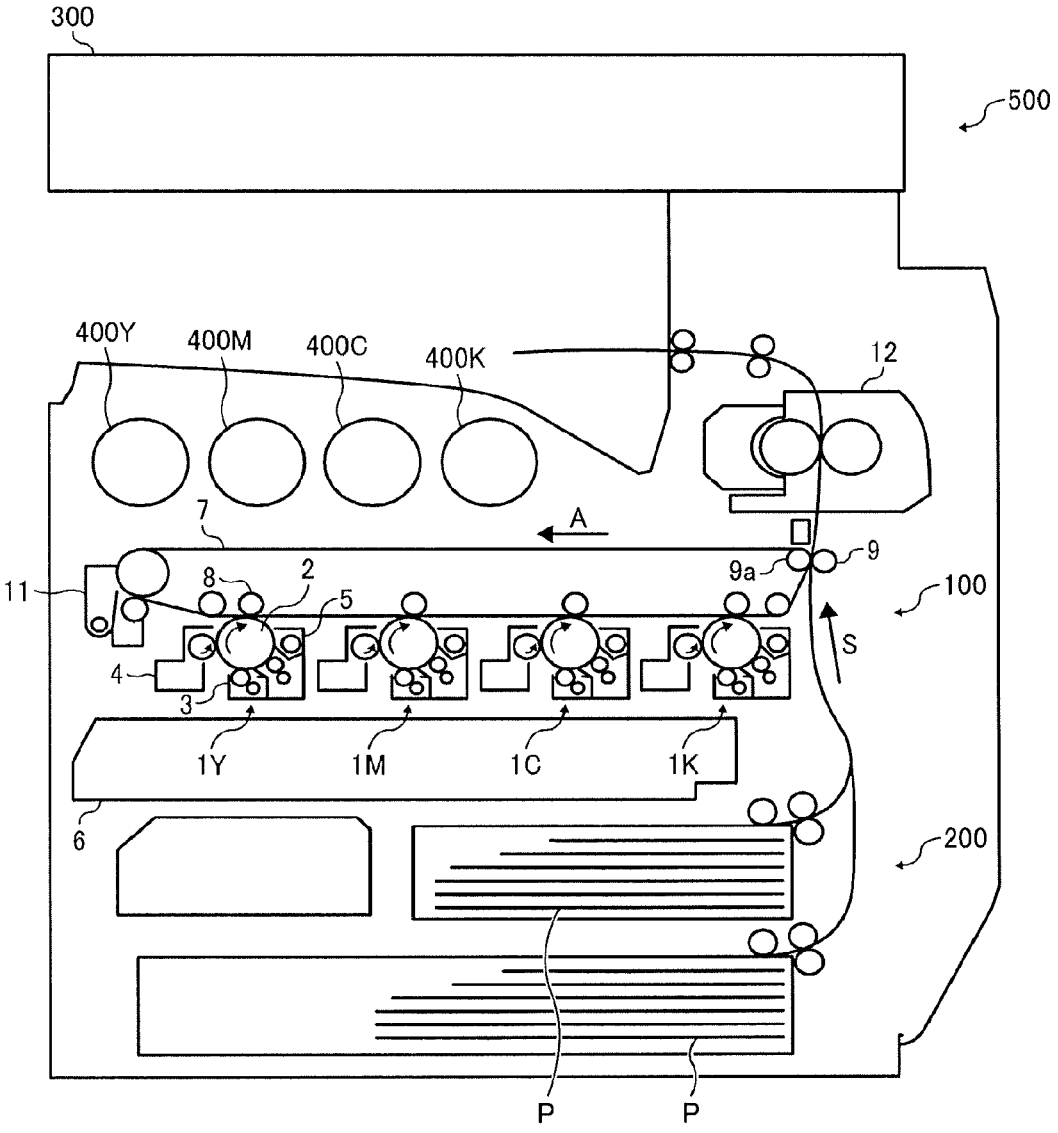
FIG. 2 is a schematic diagram illustrating an image forming apparatus according to an embodiment.

FIG. 2 is a schematic view of an image forming apparatus 500 according to an embodiment. For example, the image forming apparatus 500 in the present embodiment is a copier.

The image forming apparatus 500 includes a printer body 100, a sheet feeding table (hereinafter "sheet feeder 200"), and a scanner 300 mounted on the printer body 100.

The printer body 100 includes four process cartridges 1 (1Y, 1M, 1C, and 1K), an intermediate transfer belt 7, an exposure device 6, and a fixing device 12. The intermediate transfer member is not limited to the belt but can be a film or a drum. The intermediate transfer belt 7 serves as an intermediate transfer member and rotates in the direction indicated by arrow A in FIG. 2 (hereinafter "belt travel direction"), entrained around multiple tension rollers.

It is to be noted that the suffixes Y, M, C, and K attached to each reference numeral indicate that components indicated thereby are used for forming yellow, magenta, cyan, and black images, respectively. The four process cartridges 1 have a similar configuration except the color of toner used therein, and hereinafter the suffixes Y, M, C, and K may be omitted when color discrimination is not necessary.

Each process cartridge 1 includes a photoconductor 2, a charger 3, a developing device 4, and a photoconductor cleaning device 5, which are hold in a common unit casing. When a stopper is released, the process cartridge 1 can be installed in or removed from the printer body 100.

The photoconductor 2 rotates clockwise in the drawing as indicated by arrow illustrated therein. For example, the charger 3 is a charging roller. The charger 3 is pressed against the surface of the photoconductor 2 and rotates as the photoconductor 2 rotates. During image formation, a high-voltage power source applies a predetermined bias to the charger 3 to electrically charge the surface of the photoconductor 2. Although the process cartridge 1 according to the present embodiment includes the charger 3 that contacts the surface of the photoconductor 2, alternatively, a contactless charging device employing, for example, corona charging can be used instead.

The exposure device 6 exposes the surface of the photoconductor 2 according to image data read by the scanner 300 or input from an external device such as a computer, thereby forming an electrostatic latent image on the photoconductor 2. Although the exposure device 6 in the configuration illustrated in the drawing employs a laser beam scanning using a laser diode, the exposure device 6 is not limited to such a configuration. Alternatively, for example, a light-emitting diode (LED) array can be used.

The photoconductor cleaning device 5 removes residual toner remaining on the photoconductor 2 after the photoconductor 2 passes by a position facing the intermediate transfer belt 7.

The four process cartridges 1 form yellow, cyan, magenta, and black toner images on the respective photoconductors 2. The four process cartridges 1 are lined in the belt travel direction, in which the intermediate transfer belt 7 rotates. The toner images are sequentially transferred from the photoconductors 2 and superimposed one on another on the intermediate transfer belt 7 (i.e., primary transfer process). Thus, a visible image is formed on the intermediate transfer belt 7.

In FIG. 2, primary transfer rollers 8 serving as primary transfer members are disposed at positions facing the respective photoconductors 2 via the intermediate transfer belt 7. Receiving a primary transfer bias from a high-voltage power source, the primary transfer roller 8 generates a primary-transfer electrical field between the photoconductor 2 and the primary transfer roller 8. With the primary-transfer electrical field, the toner image is transferred from the photoconductor 2 onto the surface of the intermediate transfer belt 7. As one of the multiple tension rollers, around which the intermediate transfer belt 7 is entrained, is rotated by a driving motor, the intermediate transfer belt 7 rotates in the belt travel direction indicated by arrow A illustrated in FIG. 2. The yellow, magenta, cyan, and black toner images are sequentially superimposed on the rotating intermediate transfer belt 7 and become a multicolor (full-color) toner image.

Downstream from the process cartridges 1 in the belt travel direction, a secondary transfer roller 9 is disposed. The multiple tension rollers include a secondary-transfer backup roller 9*a*, which opposes the secondary transfer roller 9 via the intermediate transfer belt 7. The intermediate transfer belt 7 is nipped between the secondary transfer roller 9 and the secondary-transfer backup roller 9*a* (i.e., a secondary transfer nip). A predetermined voltage is applied to the secondary transfer nip between the secondary transfer roller 9 and the secondary-transfer backup roller 9*a* to generate a secondary-transfer electrical field. Transfer sheets P (i.e., recording media) fed from the sheet feeder 200 are transported in the direction indicated by arrow S illustrated in FIG. 2 (hereinafter "sheet conveyance direction") and pass through the secondary transfer nip. While the transfer sheet P passes through the secondary transfer nip, the multicolor toner image is transferred from the intermediate transfer belt 7 onto the transfer sheet P by the secondary-transfer electrical field generated between the secondary transfer roller 9 and the secondary-transfer backup roller 9*a* (secondary transfer process).

The fixing device 12 is disposed downstream from the secondary transfer nip in the sheet conveyance direction. Exiting the secondary transfer nip, the transfer sheet P reaches the fixing device 12. The fixing device 12 fixes the multicolor toner image on the transfer sheet P with heat and pressure, after which the transfer sheet P is discharged outside the image forming apparatus 500.

Meanwhile, a belt cleaner 11 collects toner that is not transferred onto the transfer sheet P in the secondary transfer nip but remains on the intermediate transfer belt 7.

As illustrated in FIG. 2, above the intermediate transfer belt 7, toner bottles 400 (400Y, 400M, 400C, and 400K) containing respective color toners are removably mounted in the image forming apparatus 500.

The toner contained in the toner bottle 400 is supplied by a toner supply device to the developing device 4 of the corresponding color.

The developing device 4 is described in further detail below.

Figure 3:
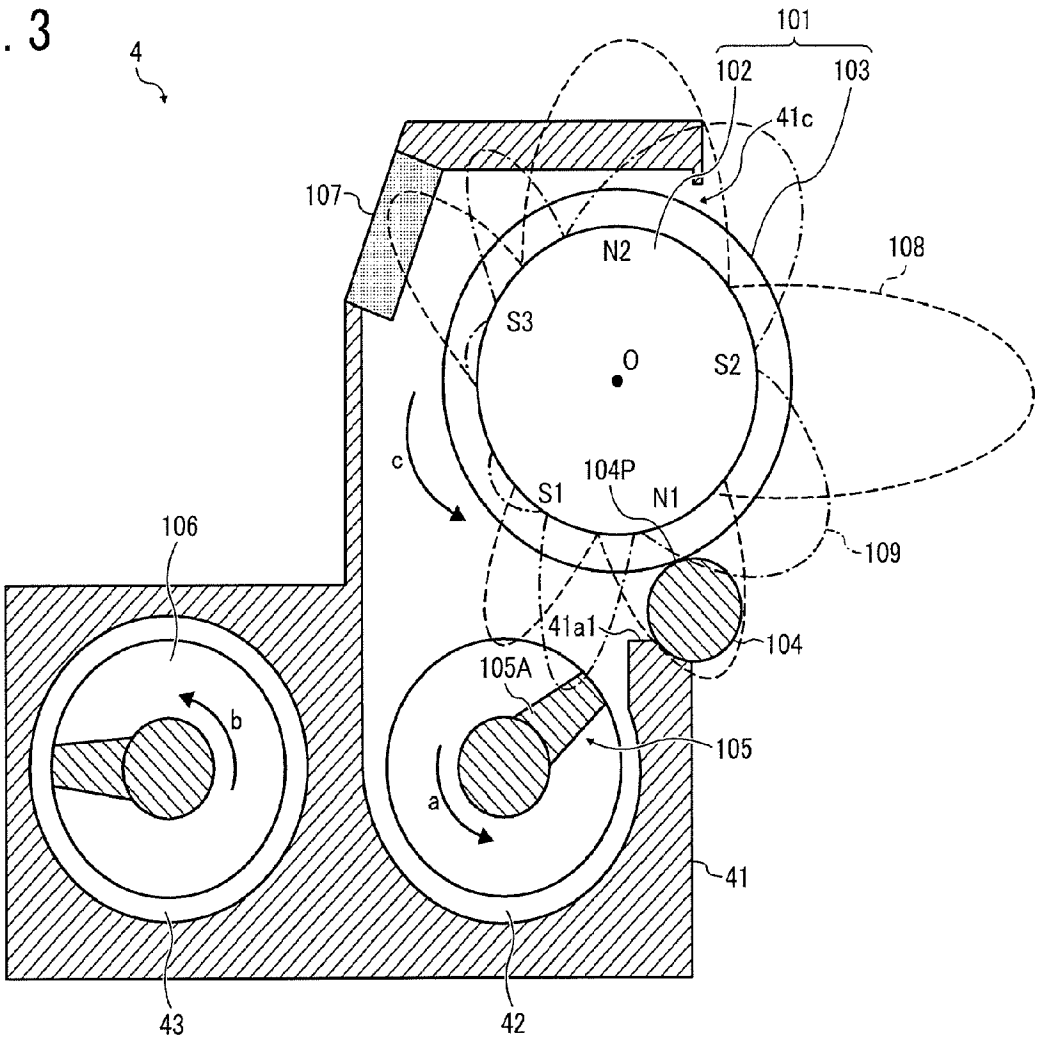
FIG. 3 is a schematic cross-sectional view of the developing device illustrated in FIG. 1.

FIG. 3 is a schematic cross-sectional view of the developing device 4. The developing device 4 includes a developing roller 101 including a magnet 102 (e.g., a magnetic field generator) and a developing sleeve 103 (i.e., a developer bearer). The magnet 102 has five magnetic poles, namely, a developer scooping pole S1, a regulation pole N1, poles S2 and N2, and a pre-release pole S3. The magnet 102 is disposed inside the developing sleeve 103, and the developing sleeve 103 bears developer (e.g., toner) on the surface thereof with the magnetic force generated by the magnet 102. The developing sleeve 103 rotates to transport the developer to the developing range, where the photoconductor 2 opposes the developing roller 101. The developing device 4 includes a doctor rod 104, which is a rod-shaped developer regulator to adjust, at a regulation position 104P, the amount of developer borne on the surface of the developing roller 101 and transported to the developing range. For example, the doctor rod 104 is made of Steel Use Stainless (SUS) according to Japan Industrial Standard (JIS). The doctor rod 104 is secured to a developing device casing 41 so that the doctor rod 104 opposes the surface of the developing roller 101 and is at a predetermined distance from the developing roller 101. The developing device casing 41 includes a developer container such as a supply compartment 42.

The developing device 4 employs two-component developer including toner and carrier.

The developer container of the developing device 4 is partitioned into a stirring compartment 43, in which a stirring screw 106 is disposed, and the supply compartment 42, in which a supply screw 105 is disposed. The stirring screw 106 agitates and charges supplied toner, and the supply screw 105 supplies the developer to the surface of the developing roller 101.

The supply screw 105 and the stirring screw 106 rotate around respective rotation axes parallel to the axis of the developing sleeve 103. The supply screw 105 and the stirring screw 106 rotate in the directions respectively indicated by arrow a and arrow b illustrated in FIG. 3 to transport the developer, thereby circulating the developer between the supply compartment 42 and the stirring compartment 43.

The magnet 102 has the developer scooping pole S1 to generate a magnetic force to attract the developer inside the supply compartment 42 onto the surface of the developing sleeve 103 and the regulation pole N1 to generate a magnetic force to cause the developer passing through the regulation position 104P to stand on end, into a magnetic brush.

The developing device casing 41 has an opening 41*c* to expose a portion of the surface of the developing roller 101. The exposed portion of the developing roller 101 opposes the surface of the photoconductor 2, forming the developing range.

The developer transported to the supply compartment 42 is scooped onto the surface of the developing roller 101 by the magnetic force exerted by the developer scooping pole S1 and the regulation pole N1 of the magnet 102. The developer is transported by the developing sleeve 103 rotating in the direction indicated by arrow c in FIG. 3. After the doctor rod 104 adjusts the amount of the developer to a predetermined amount, the developer is transported to the developing range. After the toner therein is consumed in the developing range, the developer on the developing roller 101 is returned into the developing device casing 41 as the developing sleeve 103 rotates. In the developing device casing 41, the developer is separated from the surface of the developing roller 101 by a release pole between the pre-release pole S3 and the developer scooping pole S1. Then, the developer is again stirred with the toner in the supply compartment 42. As the developer that has passed through the developing range is returned into the developing device casing 41, airflow is generated. The developing device 4 includes a vent covered with a pressure-release filter 107 to release the airflow outside the developing device 4.

The developing device 4 is described in further detail below.

FIG. 1 is an enlarged cross-sectional view of the developing roller 101 and the supply compartment 42 of the developing device 4.

In FIG. 1, broken lines 108 represent the magnetic flux density in the direction normal to the surface of the developing roller 101 (hereinafter "normal magnetic-flux density 108"), and alternate long and short dashed lines 109 represent the magnetic flux density in the direction tangential to the surface of the developing roller 101 (hereinafter "tangential magnetic-flux density 109").

In the cross section illustrated in FIG. 1, the tangential magnetic-flux density 109 reaches a peak at a peak point G positioned on the surface of the developing roller 101 and in a range where the surface of the developing roller 101 opposes the supply screw 105. An inner wall face of the developing device casing 41 includes a curved inner face 41*b* conforming to the arc-shaped circumference of a blade 105A of the supply screw 105. At a point B, which is an upper end of the curved inner face 41*b* in FIG. 1, the developer transported by the supply screw 105 is flipped up toward the developing roller 101. Further, a first virtual straight line L1 extends from an axis O (rotation center) of the supply screw 105 to the point B, and a tangent line L2 (i.e., second straight line) is a perpendicular to the first virtual straight line L1 at the point B. The tangent line L2 crosses the surface of the developing roller 101 at a point E (i.e., a flipped-developer reach point).

The developing device casing 41 includes a doctor support 41*a*, by which the doctor rod 104 is supported. The doctor support 41*a* defines a bottom end of the opening 41*c* of the developing device casing 41. The doctor support 41*a* serves as a wall (an opening-side wall) of the supply compartment 42 on the side of the opening 41*c*. An upper end face 41*a*1 (illustrated in FIG. 3) of the doctor support 41*a* is positioned below the axis O of the developing sleeve 103 and faces a range where the surface of the developing sleeve 103 moves upward in FIG. 1. A point C is positioned at an end of the upper end face 41*a*1 of the doctor support 41*a* on the side of the supply screw 105, that is, an upstream end of the upper end face 41*a*1 in the direction of rotation of the developing sleeve 103 indicated by arrow c. A third virtual straight line L3 extends from the point C to the axis O of the developing sleeve 103, and the third virtual straight line L3 crosses the surface of the developing roller 101 at a point D.

At the point D (i.e., a closest approach point), the surface of the developing sleeve 103 approaches closest to the point C (the upstream end) on the upper end face 41*a*1 of the doctor support 41*a*. The point D is downstream from the peak point G in the direction of rotation of the developing sleeve 103.

The developing device 4 is configured to satisfy A) the point E matches the peak point G or is downstream from the peak point G in the direction of rotation of the developing sleeve 103; and B) the point E matches the point D or is upstream from the point D in the direction of rotation of the developing sleeve 103. In other words, the point E is disposed in a range extending from the peak point G to the point D (the closest approach point) in the direction of rotation of the developing sleeve 103.

Developing devices employing two-component developer are described below.

In developing devices using two-component developer including toner and carrier, after the toner is consumed in the developing range, the developer is returned into the developing device. The developer is then mixed with supplied toner and used in image developing.

To attain reliable toner image quality, the toner concentration and the charge amount of the developer used in such developing devices are kept constant. The toner concentration is adjusted with the amount of toner consumed in developing and the amount of supplied toner. The developer is charged by triboelectric charging while the carrier and the toner are mixed inside the developer container (i.e., the developing device casing). In the developing range, the toner attracted to the carrier adheres to the electrostatic latent image (an image portion) on the latent image bearer, being affected by the electrical field generated between the developer bearer and the latent image bearer. At that time, the force of the electrical field (the developing range) excels the electrostatic force with the carrier, and the toner leaves the carrier and moves to the latent image bearer.

The developer charged in the developer container is magnetically attracted to the developer bearer. The developer is transported to the developing range after the developer regulator regulates the layer thickness of developer on the developer bearer. The developer regulator can be a blade or a rod. The blade-shaped developer regulator can be made of magnetic metal or nonmagnetic metal. Variations in the amount of developer on the developer bearer cause image unevenness. The direction of magnetic force waveshape of the image bearer, the strength of magnetic flux density, the relative positions of the developer regulator and the image bearer are designed to stabilize the amount of developer regulated.

In developing devices including a conveying screw to transport the developer contained in the developer container, it is possible that the amount of developer supplied to the developer bearer becomes uneven corresponding to the pitch of the screw blade, resulting in uneven image density. In particular, in developing images of high image area ratio, such as solid images, the image density becomes uneven corresponding to the screw pitch. If the density of developer in the developer containing compartment is uneven, the density of the developer scooped from the developer containing compartment onto the developer bearer is uneven. The density of the developer is not uniform immediately after being scooped by the developer scooping pole from the developer container (the supply compartment) onto the developer bearer.

By contrast, at the regulation position 104P where the developer regulator regulates the amount of developer, the developer receives force that extends in a direction perpendicular to the direction of rotation of the developer bearer, and the uneven density of the developer is leveled off. Therefore, when the developer immediately after supplied is mixed with the developer regulated at the regulation position 104P, the density of the developer reaching the regulation position 104P can be less uneven.

Descriptions are given below of an advantage of the developing device 4, illustrated in FIG. 1, according to the present embodiment.

Figure 4:
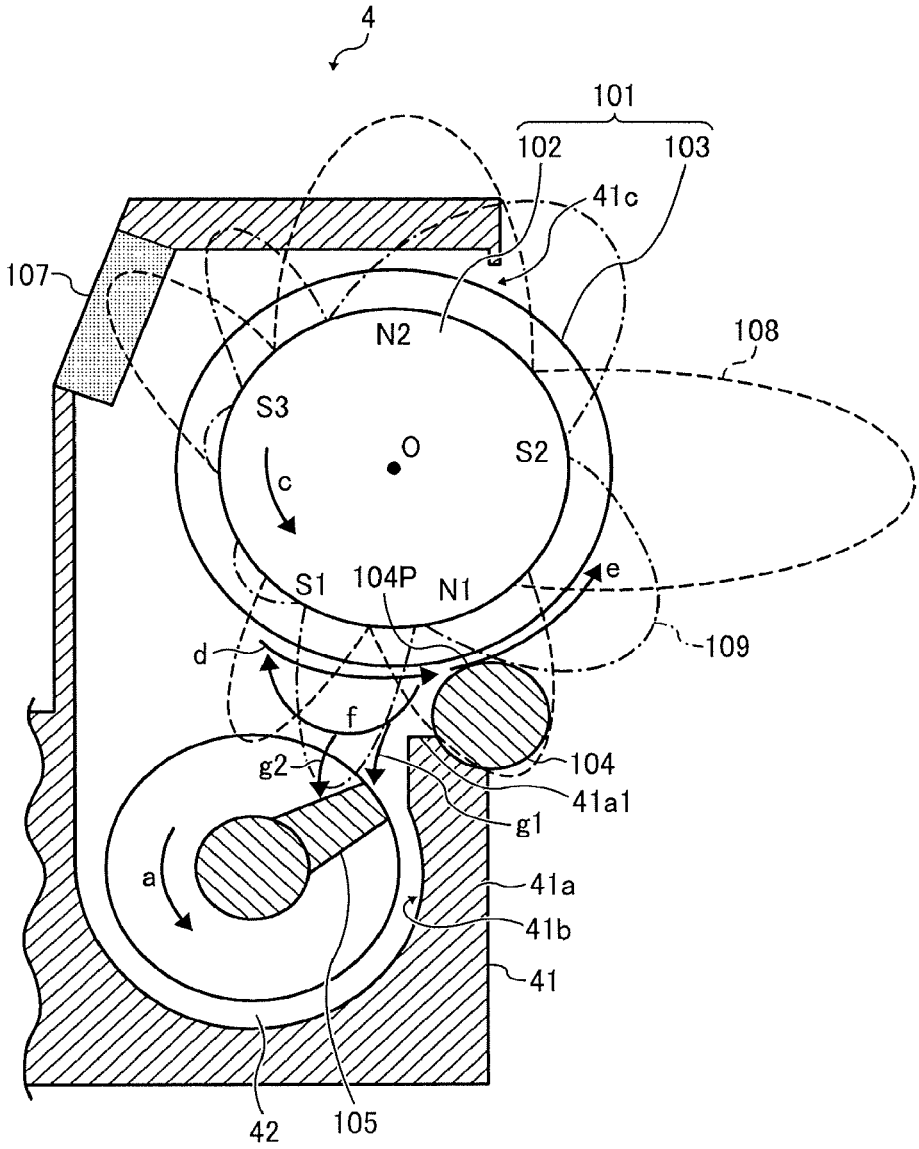
FIG. 4 is a cross-sectional view of the developing device illustrated in FIG. 1 and illustrates a flow of developer adjacent to a regulation position therein.

FIG. 4 illustrates a flow of developer around the regulation position 104P in the developing device 4 illustrated in FIG. 1. In FIG. 4, arrows e, f, g1, and g2 indicate the flow of developer.

The developing device 4 illustrated in FIG. 1 includes, as the developer regulator, the doctor rod 104 shaped like a columnar rod. Although a plate-shaped developer regulator can be used, the rod-shaped developer regulator, together with the developing roller 101, defines a wedgewise space that is narrowed in the direction of rotation of the developing sleeve 103. The wedgewise space enhances the efficiency of developer passing through the regulation position 104P, where the surface of the developing roller 101 is close to the doctor rod 104 (the developer regulator).

The term "efficiency of developer passing through the regulation position" is represented by the amount of developer passing through the regulation position 104P relative to the volume of a developer retaining area, which is enclosed by the developing roller 101, the doctor rod 104, and the upper end face 41*a*1 of the doctor support 41*a*.

When a target amount per unit time of developer transported to the developing range is identical, the distance (i.e., a doctor gap) between the developer regulator (the doctor rod 104) and the developing roller 101 does not change depending on the developer regulator shape (e.g., blade or rod). Setting the doctor gap to a distance corresponding to a desired amount of developer passing is not sufficient to attain the desired amount of developer passing. It is necessary to retain a certain amount of developer in the developer retaining area located upstream from the regulation position 104P and push the developer into the doctor gap (the regulation position 104P).

When the developer regulator is rod-shaped, the regulation position 104P is located at the leading end of the wedgewise space that is gradually narrowed, and the developer borne on the developing sleeve 103 moves toward the regulation position 104P at the leading end of the wedgewise space. Thus, pushing the developer to the regulation position 104P is facilitated. Accordingly, when the doctor gap is identical, the configuration using the rod-shaped developer regulator can attain the desired amount of developer passing with a smaller developer retaining area, compared with the configuration using the plate-shaped developer regulator.

Therefore, even when the developer retaining area is reduced and the amount of developer retained therein is reduced, a sufficient amount of developer passes through the regulation position 104P. Thus, shortage of developer in the developing range downstream from the regulation position 104P is inhibited. When the developer retaining area is made smaller to make the developing device compact, use of the rod-shaped developer regulator is advantageous in maintaining the amount of developer in the developing range.

As described above, the amount of developer retained therein decreases as the developer retaining area decreases. Although the scooped developer, which is uneven in density, is mixed with the retained developer to ameliorate the uneven density, decreases in the amount of retained developer degrades the ameliorating effect. There is a risk that the density of developer reaching the regulation position 104P is still uneven.

Referring to FIG. 4, as the developing sleeve 103 rotates, the developer attracted onto the developing roller 101 by the developer scooping pole S1 is transported to the regulation position 104P as indicated by arrow d. Then, a certain amount of developer passes through the doctor gap between the doctor rod 104 and the developing sleeve 103 and reaches the developing range as indicated by arrow e in FIG. 4.

By contrast, a portion of the developer blocked by the doctor rod 104 falls under the weight of the developer and is returned by the supply screw 105 to the supply compartment 42 as indicated by arrows g1 and g2. Being attached by the magnetic force of the developer scooping pole S1, another portion of the blocked developer is again scooped onto the developing roller 101, as indicated by arrow f, before returns to the supply compartment 42.

The developer returned to the supply compartment 42 is flipped up by the supply screw 105 as the supply screw 105 rotates. Then, the developer is attracted by the developer scooping pole S1 and scooped on the developing roller 101. Depending on the position of the blade 105A in the direction in which the supply screw 105 transports the developer (i.e., developer conveyance direction"), the density of the developer transported by the supply screw 105 in the supply compartment 42 is uneven. Scooping such developer having uneven density onto the developing roller 101 is one cause of uneven image density.

In the developing device 4 illustrated in FIG. 1, the point E matches the peak point G or is downstream from the peak point G in the direction of rotation of the developing sleeve 103, and the point E matches the point D (the closest approach point) or is upstream from the point Din the direction of rotation of the developing sleeve 103.

As the supply screw 105 rotates, the developer moves along the curved inner face 41*b* and is flipped up from the upper end (the point B) of the curved inner face 41*b* in the direction tangential to the curved inner face 41*b* toward the developing roller 101. The point E (i.e., the flipped-developer reach point), on the surface of the developing roller 101, is an arrival point of the developer flipped up from the upper end (the point B). Some of the developer flipped from the upper end (the point B) of the curved inner face 41*b* is not directed to the point E. The flipped developer spreads in a certain range in the direction of rotation of the developing sleeve 103. On the downstream side in the range in which the flipped developer spreads in the direction of rotation of the developing sleeve 103, the developer moves along the face of the doctor support 41*a* above the curved inner face 41*b* toward the surface of the developing sleeve 103.

The peak point G is positioned between the developer scooping pole S1 and the regulation pole N1, on the surface of the developing roller 101. The peak point G is a position where the tangential magnetic-flux density 109 reaches the peak and the normal magnetic-flux density 108 is small. Accordingly, the developer is less likely to receive the force in the direction normal to the surface of the developing roller 101. The developer blocked at the regulation position 104P falls toward the supply compartment 42 and passes through a range between the developer scooping pole S1 and the regulation pole N1, where the normal magnetic-flux density 108 on the surface of the developing sleeve 103 is small. Accordingly, in the space facing the peak point G, the magnetic force attracting the developer to the developing roller 101 is counteracted by the gravity. It is difficult to retain the developer on or adjacent to the surface of the developing sleeve 103 with the magnetic force.

As in the developing device 4 illustrated in FIG. 1, when the point E matches the peak point G or is downstream from the peak point G in the direction of rotation of the developing sleeve 103, the developer flipped toward the point E can support, from below, the blocked developer that is about to fall from the regulation position 104P into the supply compartment 42. Thus, the blocked developer is not returned to the supply compartment 42 but can be circulated, as indicated by arrow fin FIG. 4, to be mixed in the magnetic brush of developer attracted by the developer scooping pole S1. In other words, the blocked developer is inhibited from returning toward the supply screw 105 (flow of developer indicated by arrows g1 and g2), and the amount of developer circulating (indicated by arrow f) to be mixed in the magnetic brush of developer attracted by the developer scooping pole S1.

If the blocked developer returns to the supply compartment 42, on the upstream side of the regulation position 104P, the developer becomes sparse. In the present embodiment, the developer on the upstream side of the regulation position 104P is kept dense and circulated as indicated by arrows d and f. Thus, the amount of the blocked developer that moves to the position upstream from the regulation position 104P can increase. Mixing the blocked developer into the scooped developer can attain an enhanced effect to equalize the density of the scooped developer. Thus, the uneven density of the developer transported to the developing range is alleviated, thereby inhibiting uneven image density.

A portion of the developer that is about to fall to the supply compartment 42 is flipped up by the rotating supply screw 105 and attracted by the developer scooping pole S1. Such developer flipped and scooped contributes to equalizing the developer density.

If the developer does not flow in the direction indicated by arrow f in FIG. 4, the developer is not scooped in areas outside an area where the normal magnetic-flux density 108 exerted by the developer scooping pole S1 is strong and the adjacent area.

By contrast, in the developing device 4 illustrated in FIG. 1, the flipped developer supports, from below, the blocked developer moving toward the supply compartment 42. Then, The developer is caused to flow (in the direction indicated by arrow f) toward a magnetic-force peak position of the developer scooping pole S1 or the surface of the developing roller 101 downstream from the magnetic-force peak position. The developer flowing as indicated by arrow f is mixed in the developer scooped by the developer scooping pole S1. Accordingly, in the developing device 4 illustrated in FIG. 1, the developer is scooped from a wider range around the developer scooping pole S1. Even when the amount of developer in the supply compartment 42 is reduced, shortage of the scooped developer is inhibited.

When the point E is positioned upstream from the point D (the closest approach point) in the direction of rotation of the developing sleeve 103, the amount of developer retained upstream from the regulation position 104P can be reduced, thus increasing the amount of developer circulated between the regulation position 104P and a scooping position facing the Developer scooping pole S1. This configuration can maintain the amount of developer mixed in the uneven developer upstream from the regulation position 104P to alleviate the uneven density of the developer.

Reducing the amount of the developer retained upstream from the regulation position 104P is advantageous in inhibiting degradation of fluidity of the developer. The fluidity of the developer is maintained since the above-described circulating developer is not retained, being supported by the developing device casing 41, but continues to move.

The developing device 4 illustrated in FIG. 1 can inhibit the blocked developer from returning to the supply compartment 42 and can supply the blocked developer to the developer scooping pole S1. Thus, while maintaining the fluidity of developer, fluctuations in the density of developer moving to the regulation position 104P is reduced, thereby suppressing the occurrence of image failure.

Herein, there are two positions where the normal magnetic-flux density 108 of the regulation pole N1 on the surface of the developing roller 101 is half of the maximum value (peak) thereof. The half-maximum position upstream from the regulation position 104P (in other words, upstream from the peak position) in the direction of rotation of the developing sleeve 103 is referred to as "upstream half-maximum position of normal magnetic-flux density" of the regulation pole N1. In the developing device 4 illustrated in FIG. 4, the point E is disposed in a range extending from the peak point G to the upstream half-maximum position.

In an area upstream from the upstream half-maximum position, the developer is less likely to receive the magnetic force of the regulation pole N1 in the normal direction. The amount of developer returning to the supply compartment 42 can be restricted by flipping up the developer toward the range (e.g., ranging from the peak point G to the upstream half-maximum position) where the developer is less likely to receive the magnetic force in the direction normal to the surface of the developing roller 101. With this configuration, the amount of developer circulated between the regulation position 104P and the scooping position is increased, thereby better inhibiting fluctuations in the density of developer moving to the regulation position 104P.

If the point E is disposed downstream from the point D (the closest approach point) in the direction of rotation of the developing sleeve 103, the developing device casing 41 is present in a route through which the developer is flipped toward the point E. In this case, the flipped developer is less likely to support, from below, the developer falling from the regulation position 104P. By contrast, in the developing device 4 illustrated in FIG. 1, since the point E is upstream from the point D in the direction of rotation of the developing sleeve 103, the flipped developer supports, from below, the developer that is about to fall to the supply compartment 42.

The developing device 4 illustrated in FIG. 1 can suppress the uneven image density without degrading the fluidity of the developer. Accordingly, the process cartridge 1 including the developing device 4 can produce preferable toner images for a long time.

Further, the image forming apparatus 500 including the developing device 4 can produce preferable toner images for a long time.

Figure 5A:
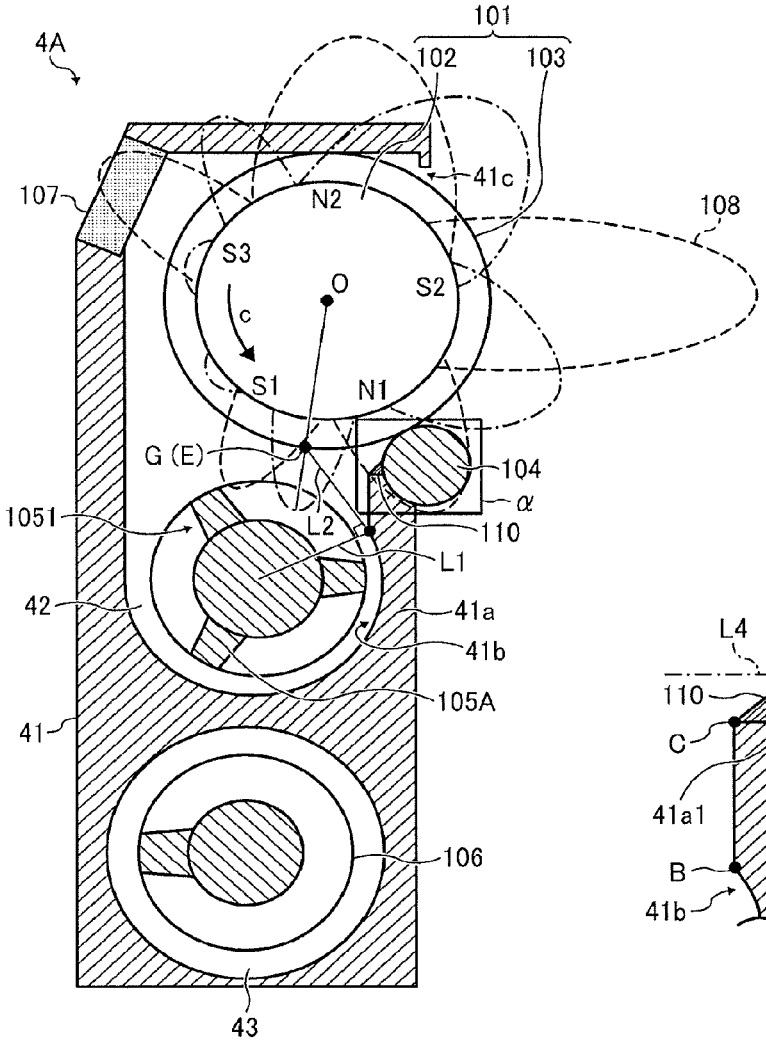
FIG. 5A is a cross-sectional view of a developing device according to another embodiment.
Figure 5B:
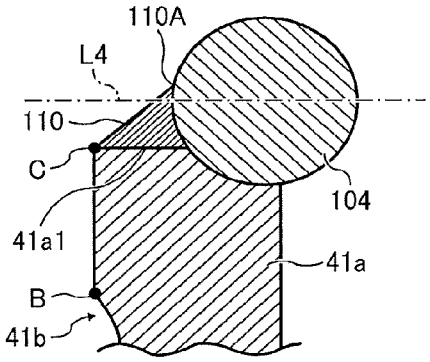
FIG. 5B is an enlarged cross-sectional view of an area a illustrated in FIG. 5A.

FIG. 5A is a cross-sectional view of a developing device 4A, as another embodiment. FIG. 5B is an enlarged cross-sectional view of an area a illustrated in FIG. 5A.

Developing devices using two-component developer include the stirring compartment to stir and charge the supplied toner and the supply compartment to supply the developer to the developer bearer. Such developing devices include two conveyors (e.g., screws, paddles, and coils) to circulate the developer (so-called biaxial circulation). In the developing device 4 illustrated in FIGS. 1 and 3, the supply screw 105 and the stirring screw 106 are arranged laterally (side by side). Alternatively, the stirring compartment and the supply compartment can be arranged vertically or substantially vertically to reduce the width of the developing device.

In the developing device 4A illustrated in FIG. 5A, the stirring compartment 43 is disposed below the supply compartment 42.

The developing device 4A illustrated in FIG. 5A uses the developing roller 101 that includes the developing sleeve 103 having an outer diameter of 16 mm and the magnet 102 having an outer diameter of 14 mm. The magnet 102 has five magnetic poles, namely, the developer scooping pole S1, the regulation pole N1, the poles S2 and N2, and the pre-release pole S3. In FIG. 5A, broken lines 108 represent the magnetic flux density in the direction normal to the surface of the developing roller 101 (hereinafter "normal magnetic-flux density 108"), and alternate long and short dashed lines 109 represent the magnetic flux density in the direction tangential to the surface of the developing roller 101 (hereinafter "tangential magnetic-flux density 109").

The doctor rod 104, serving as a developer regulator to regulate the layer thickness of the developer borne on the developing roller 101, is a metal rod made of SUS and has a diameter of 5 mm, for example. The doctor rod 104 is secured to the developing device casing 41 and disposed at 0.42 mm (doctor gap) from the developing roller 101.

The developing device 4A further includes a retention preventer 110 disposed on the upper end face 41*a*1 of the doctor support 41*a* (a portion of the developing device casing 41) securing the doctor rod 104. On the upper end face 41*a*1, the retention preventer 110 is on the inner side (on the left in FIGS. 5A and 5B) of the developing device 4A from the doctor rod 104. Referring to FIG. 5B, the retention preventer 110 has an inclined upper face that ascends from the point C (an inner end on the upper end face 41*a*1) toward the doctor rod 104. An upper end 110A of the retention preventer 110 is positioned above a virtual straight line L4 passing through a center of the doctor rod 104 on the cross section illustrated in FIG. 5B. The retention preventer 110 inhibits the developer (in particular, the developer blocked at the regulation position) from remaining in the developer retaining area enclosed by the upper end face 41*a*1 of the doctor support 41*a*, the doctor rod 104, and the developing roller 101.

The retention preventer 110 is disposed adjacent to a bottom portion of the doctor rod 104, at which the developer tends to remain. This configuration inhibits the developer from remaining and increases the amount of developer circulating between the regulation position 104P and the scooping position.

Although the retention preventer 110 is a separate component disposed on the doctor support 41*a* in FIG. 5B, alternatively, the upper end face 41*a*1 of the doctor support 41*a* can be inclined from the point C toward the doctor rod 104.

The interior of the developing device casing 41 (i.e., the developer container) is divided into the supply compartment 42 in which a supply screw 1051 is disposed and the stirring compartment 43 in which the stirring screw 106 is disposed. The supply compartment 42 and the stirring compartment 43 are arranged vertically (disposed above the other) to reduce the width of the developing device 4A while keeping a sufficient stirring capability. The supply compartment 42 communicates with the stirring compartment 43 at both ends in the developer conveyance direction (on the front side and the back side of the paper on which FIG. 5A is illustrated). At the downstream end of the supply compartment 42 in the developer conveyance direction of the supply screw 1051, the developer falls under the weight thereof to the stirring compartment 43. At the downstream end of the stirring compartment 43 in the developer conveyance direction of the stirring screw 106, the developer is lifted by the conveyance force of the stirring screw 106 from the stirring compartment 43 to the supply compartment 42. Thus, the developer circulates between the supply compartment 42 and the stirring compartment 43.

In the developing device 4A, the developer is lifted from the stirring compartment 43 to the supply compartment 42 against the gravity. In such an arrangement, to supply a stable amount of developer to the supply compartment 42, it is necessary that the amount of developer contained be greater than the amount contained in the developing device in which the stirring compartment 43 is disposed on the side of the supply compartment 42. By contrast, in the developing device 4A, since the point E is disposed in the range extending from the peak point G to the point D (the closest approach point) in the direction of rotation of the developing sleeve 103, the developer circulates between the regulation position 104P and the scooping position. Accordingly, even when the amount of scooped developer decreases, fluctuations in the amount of developer reaching the regulation position 104P are smaller. Therefore, increasing the amount of developer contained in the developing device 4A is not necessary, and the cost of the developing device 4A can be reduced while reducing the width of the developing device 4A.

For example, the stirring screw 106 has an outer diameter of 15 mm, a shaft diameter of 6 mm, and a screw pitch of 20 mm. The supply screw 1051 has an outer diameter of 12 mm, a shaft diameter of 8 mm, and a screw pitch of 15 mm. The supply screw 1051 is triple-threaded and has three spiral blades 105A. With such screws, the amount of developer in the stirring compartment 43 and that in the supply compartment 42 are balanced.

The triple-threaded supply screw 1051 increases the frequency per one rotation of developer flipping by the supply screw 1051. Accordingly, the amount of blocked developer returning from the regulation position 104P to the supply compartment 42 is suppressed, thereby better inhibiting the uneven density of developer moving to the regulation position 104P.

Similar to FIG. 1, in the cross section illustrated in FIGS. 5A and 5B, the tangential magnetic-flux density 109 reaches a peak at the peak point G positioned on the surface of the developing roller 101 and in the range where the surface of the developing roller 101 opposes the supply screw 1051. The point B is at the upper end of the curved inner face 41*b*, which conforms to the circumference of the blade 105A of the supply screw 1051, of the inner wall face of the developing device casing 41 includes. The developer transported by the supply screw 1051 is flipped up from the point B. Further, the tangent line L2 extending from the point B is a perpendicular to the first virtual straight line L1, which extends from the axis O of the supply screw 1051 to the point B. The point E is the intersection where the tangent line L2 crosses the surface of the developing roller 101.

In the developing device 4A illustrated in FIGS. 5A and 5B, the tangent line L2 passes through the peak point G. With this arrangement, the blocked developer falling toward the supply compartment 42 is supported, from below, by the developer flipped up by the supply screw 1051. Thus, the blocked developer is circulated and mixed in the developer attracted by the developer scooping pole S1, as indicated by arrow fin FIG. 4.

Comparative Example 1

Descriptions are given below of developing devices according to comparative examples.

Figure 8:
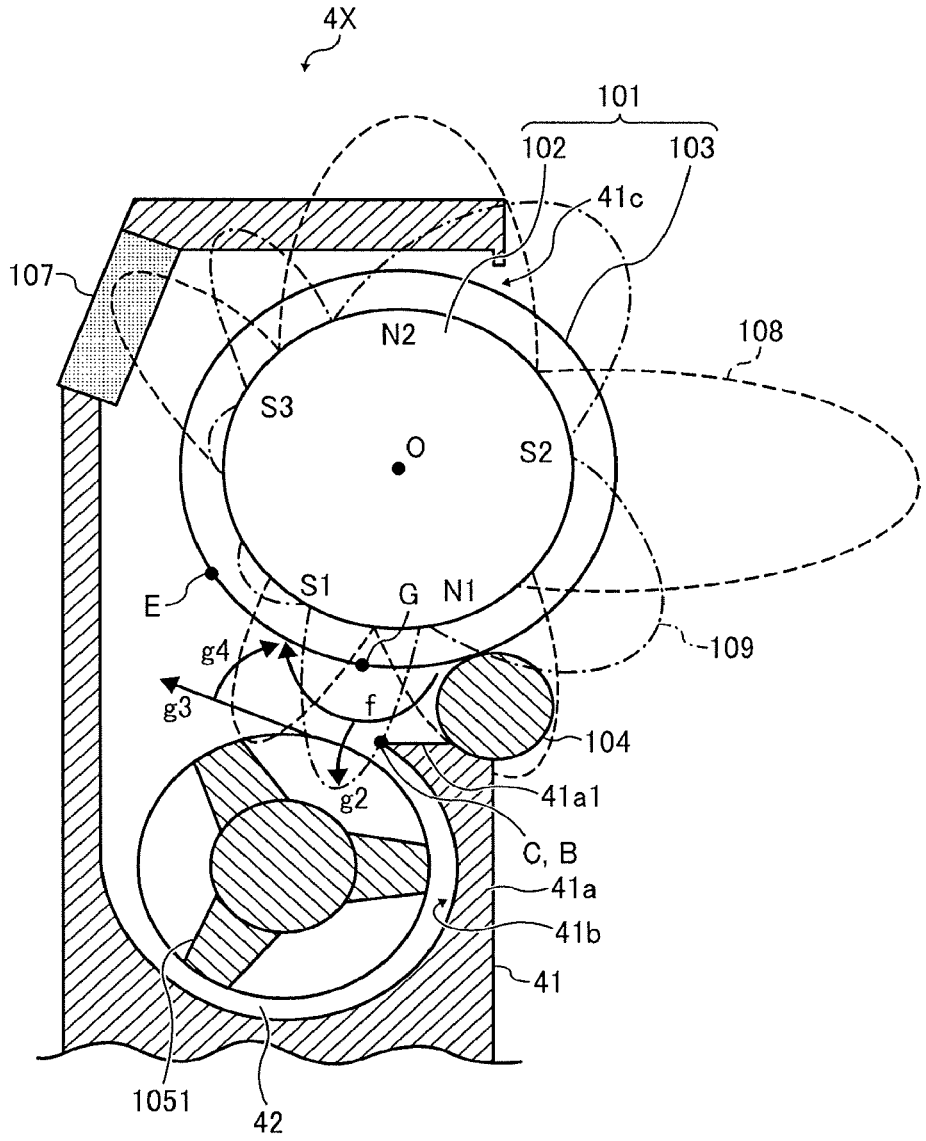
FIG. 8 is an enlarged cross-sectional view of a developing roller and a supply compartment of a developing device according to a comparative example.

FIG. 8 is an enlarged cross-sectional view of the developing roller 101 and the supply compartment 42 of a developing device 4X according to Comparative example 1. FIG. 8 illustrates a flow of developer around the regulation position 104P.

The developing roller 101, the doctor rod 104, and the supply screw 105 of the developing device 4X are identical or similar to those of the developing device 4A illustrated in FIGS. 5A and 8B. In the developing device 4X, however, the point E on the surface of the developing roller 101, which is an arrival point of the developer flipped up from the upper end (the point B) of the curved inner face 41*b* toward the developing roller 101, is positioned upstream, in the rotation direction of the developing roller 101, from the peak point G, which is the peak of the tangential magnetic-flux density 109 in the range between the developer scooping pole S1 and the regulation pole N1.

Compared with the developing device 4A, in FIG. 8, the developer returning to the supply compartment 42 (indicated by arrow g2), from the flow of circulating developer (indicated by arrow f), is more susceptible to the force in the direction indicated by arrow g3 in FIG. 8, caused by the developer flipped by the supply screw 105.

A portion of the developer affected by the force in the direction indicated by arrow g3 is again scooped by the developer scooping pole S1 as indicated by arrow g4 illustrated in FIG. 8. Compared with the developing device 4A illustrated in FIG. 5A, however, the amount of the developer returning to the supply compartment 42 is greater. Accordingly, the developer becomes sparse on the upstream side of the regulation position 104P more easily, and the image density becomes uneven more easily.

Figure 6:
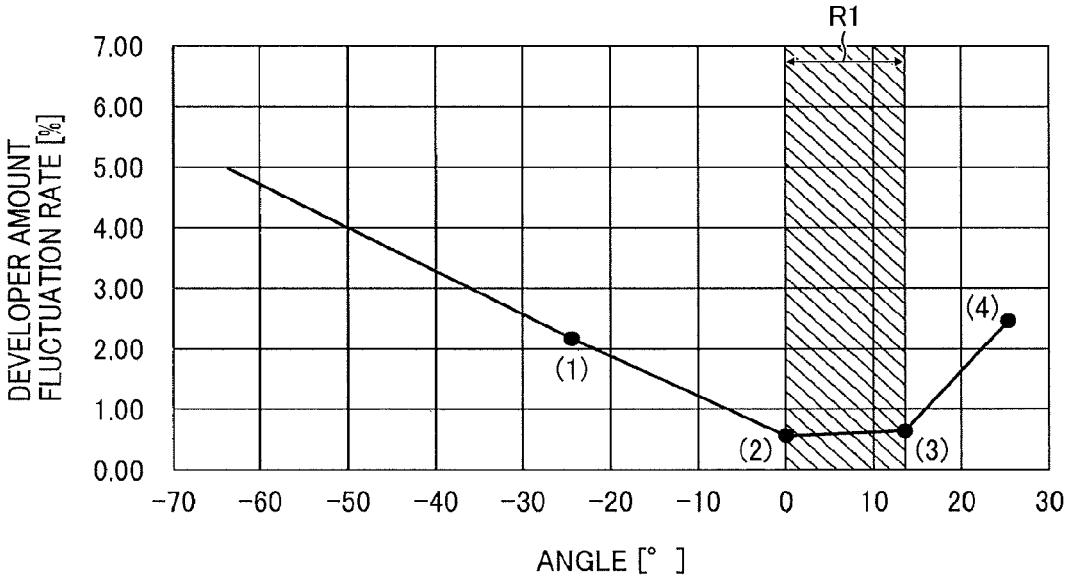
FIG. 6 is a graph of fluctuation rates of the amount of developer upstream from the regulation position measured while changing the position of an intersection between a tangent line to a curved inner face crosses the surface of a developing sleeve.

FIG. 6 is a graph of fluctuation rates of the amount of developer upstream from the regulation position 104P when the shape of the doctor support 41*a* of the developing device casing 41 is changed to change the position of the point E.

In FIG. 6, the abscissa represents an angle (at the axis O) between a virtual segment OG, which connects the axis O and the peak point G, and a virtual segment OE, which connects the axis O and the point E in FIG. 1.

In FIG. 6, a plot (1) represents the result measured in the developing device 4X illustrated in FIG. 8, according to Comparative example 1, and the angle between the virtual segment OG and the virtual segment OE is −24 degrees. A plot (2) in FIG. 6 represents the result measured in the developing device 4A illustrated in FIG. 5A, and the angle between the virtual segment OG and the virtual segment OE is 0 degree. In the developing device 4A illustrated in FIGS. 5A and 5B, the point Eon the surface of the developing roller 101, which is the arrival point of the developer flipped up from the upper end (the point B) of the curved inner face 41*b*, matches the peak point G, which is the peak of the tangential magnetic-flux density 109 in the range between the developer scooping pole S1 and the regulation pole N1.

Figure 7:
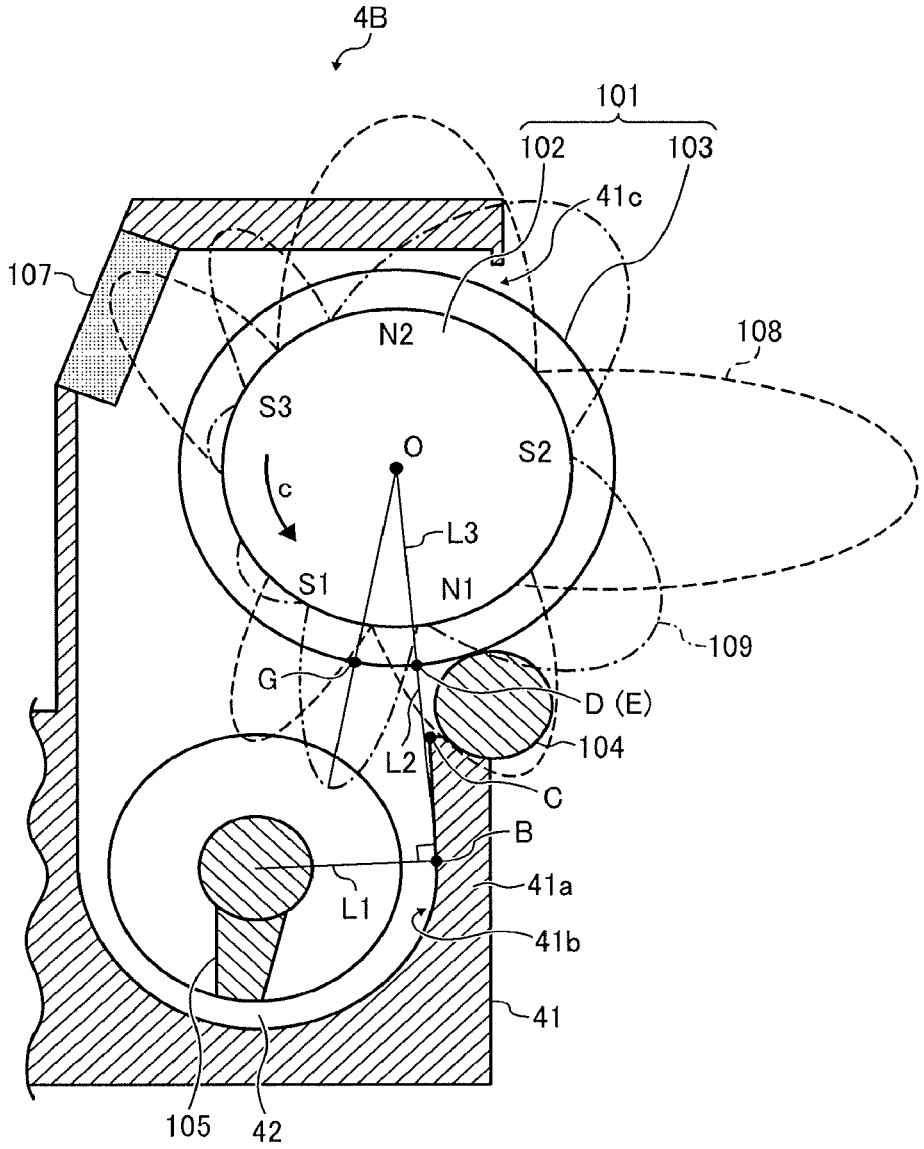
FIG. 7 is an enlarged cross-sectional view of a developing roller and a supply compartment of a developing device according to another embodiment.
Figure 9:
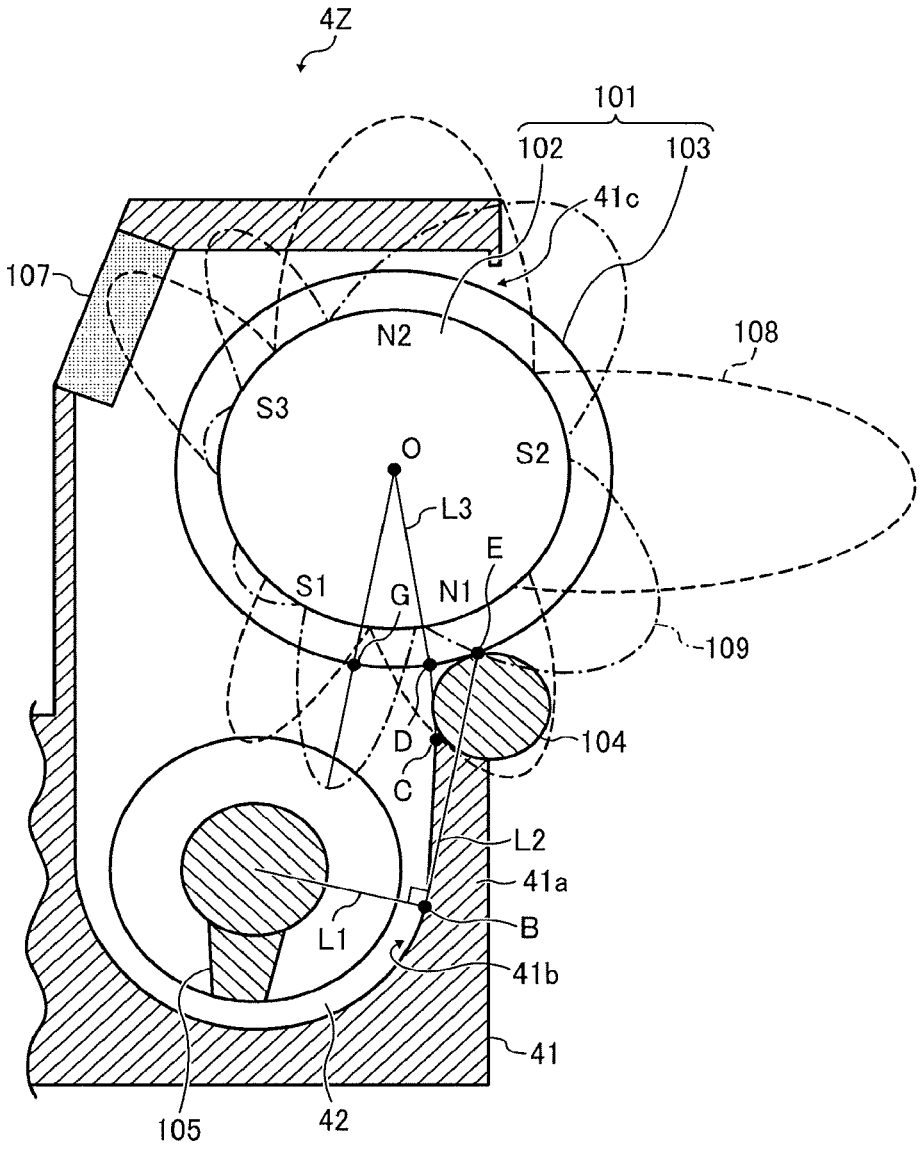
FIG. 9 is an enlarged cross-sectional view of a developing roller and a supply compartment of a developing device according to another comparative example.

FIG. 7 is an enlarged cross-sectional view of the developing roller 101 and the supply compartment 42 of a developing device 4B, as another embodiment. In FIG. 7, the point E matches the point D. FIG. 9 is an enlarged cross-sectional view of the developing roller 101 and the supply compartment 42 of a developing device 4Z, according to Comparative example 2 In FIG. 9, the point E is positioned downstream from the point D in the direction of rotation of the developing sleeve 103.

In FIG. 6, a plot (3) represents the result measured in the developing device 4B illustrated in FIG. 7, and a plot (4) represents the result measured in the developing device 4Z illustrated in FIG. 9, according to Comparative example 2.

If the result measured in the developing device 4 illustrated in FIG. 1 is plotted in FIG. 6, the plot would be positioned between the plot (2) and the plot (3). That is, in a range R1 in FIG. 6, the point E is disposed in the range extending from the peak point G to the point D (the closest approach point).

In FIG. 6, the abscissa is set such that the value (angle) is positive (+) when the point E deviates from the peak point G toward the doctor rod 104, and the value is negative (−) when the point E deviates from the peak point G toward the pre-release pole S3. Regarding the ordinate in FIG. 6, the density of the carrier in the developer retaining area was measured, and the amount of developer was converted to the weight. FIG. 6 illustrates the degree of changes in the weight of the developer during the driving of the developing device 4A, 4B, 4X, and 4Z. To obtain the results illustrated in FIG. 6, the amount of developer contained was reduced by 20% from a specified amount of developer contained, and the developing device 4A, 4B, 4X, and 4Z were driven for 10 seconds. Then, the fluctuation rate of the amount of developer in the developer retaining area was measured and plotted in FIG. 6.

As illustrated in FIG. 6, when the point E matches the peak point G (in the developing device 4A illustrated in FIGS. 5A and 5B), the fluctuation rate of the developer amount is smaller. By contrast, the fluctuation rate of the developer amount is greater in the configuration in which the point E deviates from the peak point G, such as in Comparative example 1 illustrated in FIG. 8, in which the angle between the virtual segment OG and the virtual segment OE is −24 degrees.

The various aspects of the present specification can attain specific effects as follows.

Aspect A

Aspect A concerns a developing device that includes a developer bearer, such as the developing sleeve 103, containing a magnetic field generator (e.g., the magnet 102) to exert a magnetic force to bear developer on a surface of the developer bearer; a developer regulator such as the doctor rod 104; a developer conveyor, such as the supply screw 105, configured to rotate and disposed inside a developer containing compartment, such as the supply compartment 42; a casing (e.g., the developing device casing 41) having an opening (e.g., the opening 41*c*) and defining the developer containing compartment (e.g., the supply compartment 42) disposed below the developer bearer. The casing includes a side wall (e.g., the doctor support 41*a*) defining a bottom end of the opening and a side face of the developer containing compartment on a side of the opening. The developer regulator is disposed on the side wall (the doctor support 41*a*). An upper end face (e.g., the upper end face 41*a*1) of the side wall (e.g., the doctor support 41*a*) faces a surface of the developer bearer in a range below an axis of the developer bearer. Additionally, the side wall (e.g., the doctor support 41*a*) includes a curved inner face (e.g., the curved inner face 41*b*) conforming to an orbit of rotation of an outer circumference of the developer conveyor. The curved inner face extends from below the developer conveyor (toward a side of the developer conveyor).

In such a configuration, on a virtual plane perpendicular to the axis of the developer bearer, an intersection (e.g., the point E) where a tangent line (L2) tangential to an upper end (the point B) of the curved inner face crosses the surface of the developer bearer is positioned in a range extending from a tangential magnetic-flux peak (e.g., the peak point G) to a point D (the closest approach point). The tangential magnetic-flux peak is positioned on the surface of the developer bearer in a range from the developer scooping pole (S1) to the regulation pole (N1). The point D is on the surface of the developer bearer closest to an upstream end (e.g., the point C) of the upper end face (41*a*1) in the direction of rotation of the developer bearer.

As described above, this configuration can alleviate uneven image density without lowering the fluidity of the developer.

Specifically, while rotating, the developer conveyor transports the developer along the curved inner face (41*b*) and flips up the developer from the upper end (the point B) of the curved inner face in the direction tangential to the curved inner face, toward the developer bearer. The flipped developer reaches the point E, which is the intersection between the above-mentioned tangent line and the surface of the developer bearer. The point E is also referred to as "flipped-developer reach point". Since the flipped-developer reach point (the point E) is disposed at or upstream from the closest approach point (the point D) in the direction of rotation of the developer bearer, the flipped developer can lift the developer falling from the regulation position toward the developer containing compartment, through the space opposite the closest approach point. Accordingly, the developer is inhibited from falling to the developer containing compartment and retained close to the surface of the developer bearer.

At the above-mentioned tangential magnetic-flux peak (e.g., the peak point G), the developer immediately after being supplied onto the developer bearer is caused to form a magnetic brush by the magnetic force of the magnetic field generator magnetic brush of developer immediately but lies lowest. The magnetic brush of developer rises up downstream from the tangential magnetic-flux peak in the direction of rotation of the developer bearer. Since the flipped-developer reach point is disposed at or downstream from the tangential magnetic-flux peak in the direction of rotation of the developer bearer, the lifted developer, retained close to the surface of the developer bearer, can be mixed in the rising magnetic brush. Thus, the unevenly dispersed developer immediately after being supplied onto the developer bearer by the developer scooping pole, in the form of the magnetic force, is mixed with the developer that has been blocked at the regulation position and is more uniform in density. Therefore, the uneven developer immediately after being supplied onto the developer bearer is made more uniform in density, and uneven image density can be inhibited.

The flipped developer mixed in the magnetic brush keeps moving, not remaining there. Accordingly, the fluidity of developer is not degraded by the retention of developer.

Thus, according to Aspect A, the uneven image density is inhibited without lowering the fluidity of the developer.

Aspect B

In Aspect B, the developer regulator such as the doctor rod 104 is columnar and extends parallel to the axis of the developer bearer such as the developing sleeve 103.

According to this aspect, as described above, the developing device can be made compact without reducing the amount of developer in the developing range.

Aspect C

In Aspect B, the upper end face (e.g., the upper end face 41*a*1 of the doctor support 41*a*) is inclined upward in the direction of rotation of the developer bearer, and the developer regulator (e.g., the doctor rod 104) is secured at a downstream end of the upper end face in the direction of rotation of the developer bearer. The downstream end of the upper end face in the direction of rotation of the developer bearer is disposed above a center of a columnar cross-section of the developer regulator.

As described above, this configuration can inhibit retention of developer adjacent to the bottom portion of the developer regulator, at which the developer tends to remain. This configuration increases the amount of developer mixed in the magnetic brush after being blocked at the regulation position.

Aspect D

In any one of Aspects A through C, the intersection (e.g., the point E), where the tangent line (L2) tangential to the curved inner face crosses the surface of the developer bearer, is disposed in a range extending from the tangential magnetic-flux peak (the peak point G) to an upstream half-maximum position, when the half-maximum position satisfies A) a position where the normal magnetic-flux density (108) of the magnetic force of the regulation pole (N1) on the surface of the developing roller 101 is the half of the peak thereof, and B) a position upstream from the regulation position in the direction of rotation of the developer bearer.

As described above, according to Aspect D, the developer is flipped up toward the range (e.g., ranging from the peak point G to the upstream half-maximum position) where the developer is less likely to receive the magnetic force in the direction normal to the surface of the developing roller 101, thus restricting the amount of developer returning to the supply compartment 42. Accordingly, the amount of the blocked developer mixed in the magnetic brush is increased, thereby better inhibiting fluctuations in the density of developer moving to the regulation position.

Aspect E

In any one of Aspects A through D, the developer conveyor (e.g., the supply screw 1051) has a plurality of threads.

As described above, the multi-threaded developer conveyor can increase the frequency of developer flipping, and the amount of the blocked developer mixed in the magnetic brush is increased. Thus, fluctuations in the density of developer moving to the regulation position are better inhibited.

Aspect F

In any one of Aspects A through E, the developer conveyor (e.g., the supply screws 105 and 1051) is configured to rotate to transport the developer contained in the developer containing compartment in the axial direction of the developer conveyor. The developer containing compartment includes a supply compartment (42) in which the developer conveyor is disposed, and a circulation compartment, such as the stirring compartment 43, to circulate the developer from the downstream end of the supply compartment to the upstream end of the supply compartment in the direction in which the developer conveyor transports the developer in the supply compartment. The circulation compartment is disposed below the supply compartment.

With such a vertical arrangement, as described above, increasing the amount of developer contained in the developing device is obviated. Accordingly, the cost of the developing device can be reduced while making the developing device compact.

Aspect G

A process cartridge includes a latent image bearer such as the photoconductor 2 to bear a latent image, and the developing device according to claim 1 to any one of Aspects A through F to develop the latent image.

With this aspect, preferable toner images can be produced for a long time as described above.

Aspect H

An image forming apparatus, such as the image forming apparatus 500, includes a latent image bearer (e.g., the photoconductor 2) and the developing device according to any of aspects A through F, to develop the latent image on the latent image bearer.

With this aspect, preferable images can be produced for a long time as described above.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer to bear developer;

a magnetic field generator disposed inside the developer bearer and having a developer scooping pole to attract the developer and a regulation pole to cause the developer to stand on end on the developer bearer;

a casing having an opening and defining a developer containing compartment disposed below the developer bearer, the casing including a side wall defining a bottom end of the opening;

a developer conveyor disposed inside the developer containing compartment, the developer conveyor to rotate; and a developer regulator to adjust a layer thickness of the developer on the developer bearer, the developer regulator disposed on the side wall, wherein the side wall includes:

an upper end face disposed facing a surface of the developer bearer at a position below an axis of the developer bearer; and a curved inner face curved along an orbit of rotation of an outer circumference of the developer conveyor, the curved inner face extending from below the developer conveyor toward the upper end face, and wherein, on a virtual plane perpendicular to the axis of the developer bearer, an intersection between a tangent line tangential to an upper end of the curved inner face and the surface of the developer bearer is positioned in a range extending from a tangential magnetic-flux peak to a closest approach point, the tangential magnetic-flux peak positioned on the surface of the developer bearer in a range extending from the developer scooping pole to the regulation pole, the closest approach point disposed on the surface of the developer bearer closest to an upstream end of the upper end face in a direction of rotation of the developer bearer, wherein the developer regulator is columnar and extends in a direction parallel to the axis of the developer bearer, wherein the upper end face is inclined upward in the direction of rotation of the developer bearer, and wherein the developer regulator is secured to a downstream end of the upper end face in the direction of rotation of the developer bearer, the downstream end of the upper end face disposed above a center of a columnar cross-section of the developer regulator.

2. The developing device according to claim 1, wherein the developer conveyor has a plurality of threads.

3. The developing device according to claim 1, wherein the developer conveyor is to rotate to transport the developer contained in the developer containing compartment in an axial direction of the developer conveyor, wherein the developer containing compartment includes:

a supply compartment in which the developer conveyor is disposed; and a circulation compartment to circulate the developer from a downstream end of the supply compartment to an upstream end of the supply compartment in a direction in which the developer conveyor transports the developer in the supply compartment, the circulation compartment is disposed below the supply compartment.

4. A process cartridge comprising:

a latent image bearer to bear a latent image; and the developing device according to claim 1 to develop the latent image with the developer.

5. An image forming apparatus comprising:

a latent image bearer to bear a latent image; and the developing device according to claim 1 to develop the latent image with the developer.

6. A developing device comprising:

a developer bearer to bear developer;

a magnetic field generator disposed inside the developer bearer and having a developer scooping pole to attract the developer and a regulation pole to cause the developer to stand on end on the developer bearer;

a casing having an opening and defining a developer containing compartment disposed below the developer bearer, the casing including a side wall defining a bottom end of the opening;

a developer conveyor disposed inside the developer containing compartment, the developer conveyor to rotate; and a developer regulator to adjust a layer thickness of the developer on the developer bearer, the developer regulator disposed on the side wall, wherein the side wall includes:

an upper end face disposed facing a surface of the developer bearer at a position below an axis of the developer bearer; and a curved inner face curved along an orbit of rotation of an outer circumference of the developer conveyor, the curved inner face extending from below the developer conveyor toward the upper end face, and wherein, on a virtual plane perpendicular to the axis of the developer bearer, an intersection between a tangent line tangential to an upper end of the curved inner face and the surface of the developer bearer is positioned in a range extending from a tangential magnetic-flux peak to a closest approach point, the tangential magnetic-flux peak positioned on the surface of the developer bearer in a range extending from the developer scooping pole to the regulation pole, the closest approach point disposed on the surface of the developer bearer closest to an upstream end of the upper end face in a direction of rotation of the developer bearer, wherein the intersection between the tangent line tangential to the curved inner face and the surface of the developer bearer is disposed in a range extending from the tangential magnetic-flux peak to an upstream half-maximum position at which a normal magnetic-flux density of a magnetic force of the regulation pole on the surface of the developer bearer is half of a maximum value of the normal magnetic-flux density, the upstream half-maximum position located upstream from a regulation position on the developer bearer in the direction of rotation of the developer bearer.

7. The developing device according to claim 6, wherein the developer regulator is columnar and extends in a direction parallel to the axis of the developer bearer.

8. The developing device according to claim 7, wherein the upper end face is inclined upward in the direction of rotation of the developer bearer, and wherein the developer regulator is secured to a downstream end of the upper end face in the direction of rotation of the developer bearer, the downstream end of the upper end face disposed above a center of a columnar cross-section of the developer regulator.

9. The developing device according to claim 6, wherein the developer conveyor has a plurality of threads.

10. The developing device according to claim 6, wherein the developer conveyor is to rotate to transport the developer contained in the developer containing compartment in an axial direction of the developer conveyor, wherein the developer containing compartment includes:

a supply compartment in which the developer conveyor is disposed; and a circulation compartment to circulate the developer from a downstream end of the supply compartment to an upstream end of the supply compartment in a direction in which the developer conveyor transports the developer in the supply compartment, the circulation compartment is disposed below the supply compartment.

11. A process cartridge comprising:

a latent image bearer to bear a latent image; and the developing device according to claim 6 to develop the latent image with the developer.

12. An image forming apparatus comprising:

a latent image bearer to bear a latent image; and the developing device according to claim 6 to develop the latent image with the developer.

* * * * *